US008963774B1

(12) United States Patent
Livadaru et al.

(10) Patent No.: US 8,963,774 B1
(45) Date of Patent: Feb. 24, 2015

(54) ADAPTIVE NULLING FOR PARASITIC ARRAY ANTENNAS

(75) Inventors: Matilda G. Livadaru, Marion, IA (US); Lee M. Paulsen, Cedar Rapids, IA (US); Daniel B. Roggendorf, Marion, IA (US); Jeremiah D. Wolf, Marion, IA (US); Wajih A. ElSallal, Cedar Rapids, IA (US); James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 337 days.

(21) Appl. No.: 13/494,337

(22) Filed: Jun. 12, 2012

(51) Int. Cl.
*H01Q 3/02* (2006.01)

(52) U.S. Cl.
USPC ..... 342/374

(58) Field of Classification Search
USPC ..... 342/374, 447, 448, 445
See application file for complete search history.

(56) References Cited

U.S. PATENT DOCUMENTS

2005/0212714 A1* 9/2005 Chiang et al. ..... 343/810
2010/0149067 A1* 6/2010 Williams et al. ..... 343/876

* cited by examiner

*Primary Examiner* — Harry Liu
(74) *Attorney, Agent, or Firm* — Angel N. Gerdzhikov; Donna P. Suchy; Daniel M. Barbieri

(57) ABSTRACT

A parasitic array antenna and a beamforming method for such a parasitic array antenna are disclosed. The parasitic array antenna may include a single driven element at the center of a ground plane. The driven element may be surrounded by multiple parasitic elements. RF loading may be selectively applied to each parasitic element. When symmetric loading is applied to the parasitic elements, the parasitic array antenna may function as an omnidirectional antenna. When asymmetric loading is applied to the parasitic elements, a null and a directional beam may be formed for the parasitic array antenna, therefore providing beamforming capabilities to the parasitic array antenna.

20 Claims, 5 Drawing Sheets

ADAPTIVE NULLING FOR PARASITIC ARRAY ANTENNAS

TECHNICAL FIELD

The present disclosure relates generally to antenna systems, and more particularly to parasitic array antennas.

BACKGROUND

Parasitic array antennas include one or more parasitic elements with an active/driven element. The driven element is connected to a transceiver but the parasitic elements are not. The amount of power gain and directivity of a parasitic array antenna may depend on the lengths of the parasitic elements and the spacing between them. In addition, radio frequency (RF) loading on the parasitic elements may also affect mutual coupling and reflectivity of parasitic array antennas.

Beamforming is a signal processing technique for directional signal transmission or reception. Such techniques may allow an antenna to produce high directional beams in the desired directions and nulls in the undesired directions, thereby increasing the signal-to-noise ratio in the desired directions and reducing interference and wastage of transmitted power in the undesired directions.

Existing solutions for forming nulls and directional beams for parasitic array antennas involve using adjustable reactance such as varactors (variable capacitance diodes) or the like. Such solutions are complicated and expensive. Therein lies a need for a low cost parasitic array antenna and a beamforming method for such a low cost parasitic array antenna.

SUMMARY

The present disclosure is directed to an antenna system. The antenna system may include a ground plane, a driven element having an omnidirectional radiation pattern mounted to the ground plane, and an array of parasitic elements mounted to the ground plane. The array of parasitic elements may be positioned to surround the driven element. The antenna system may also include a controller configured for selectively applying a load to each of the array of parasitic elements, wherein the array of parasitic elements functions as a steerable reflector for reflecting the radiation pattern of the driven element.

Another embodiment of the present disclosure is directed to a beamforming method for a parasitic array antenna. The method may include specifying a main beam direction and/or a null direction; determining a load configuration pattern for an array of parasitic elements, wherein the array of parasitic elements are mounted to a ground plane of the parasitic array antenna, and the array of parasitic elements are positioned to surround a driven element mounted to the ground plane of the parasitic array antenna; and selectively applying a load to each of the array of parasitic elements according to the load configuration pattern, wherein the array of parasitic elements functions as a steerable reflector for reflecting a radiation pattern of the driven element.

A further embodiment of the present disclosure is directed to an antenna system. The antenna system may include a ground plane, a driven element having an omnidirectional radiation pattern mounted to the ground plane, and an array of parasitic elements mounted to the ground plane. The array of parasitic elements may be positioned to surround the driven element, and each parasitic element of the array of parasitic elements may be in equal distance away from the driven element. The antenna system may further include a controller configured for selectively applying a binary switchable load to each of the array of parasitic elements, wherein the array of parasitic elements functions as a steerable reflector for reflecting the radiation pattern of the driven element.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION

Reference will now be made in detail to exemplary embodiments of the disclosure, examples of which are illustrated in the accompanying drawings.

Figure 1:
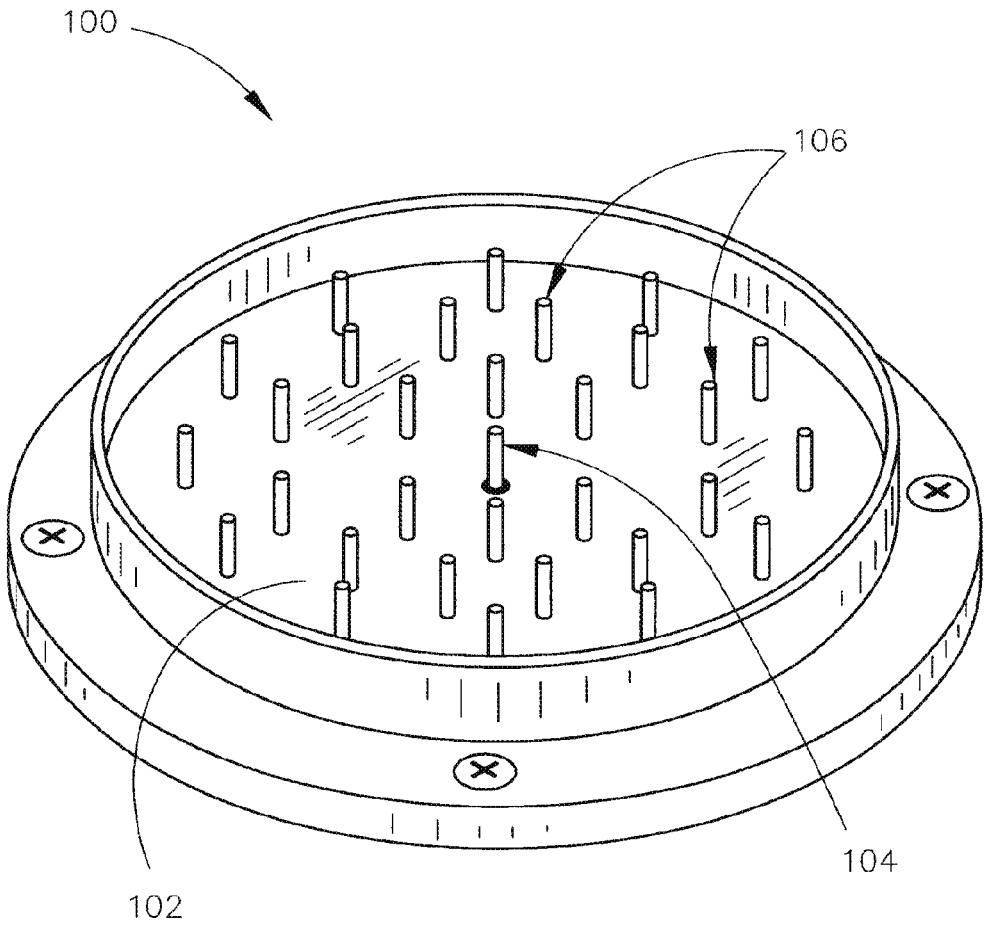
FIG. 1 is an isometric view of a parasitic array antenna.

The present disclosure is directed to a parasitic array antenna and a beamforming method for such a parasitic array antenna. Referring to FIG. 1, an isometric view of an exemplary antenna system 100 in accordance with the present disclosure is shown. The antenna system 100 includes a ground plane 102 (may also be referred to as base plane) and a driven element 104 mounted through the ground plane 102. The driven element 104 may be any active antenna element capable of generating an omnidirectional radiation pattern, such as a monopole or the like. The driven element 104 is surrounded by one or more arrays of parasitic elements 106 also mounted to the ground plane 102. In one embodiment, each array of parasitic elements 106 may form a ring around the centrally located driven element 104.

It is understood that the term ring is utilized to describe the relationship between an array of parasitic elements and the driven element 104, where each parasitic element 106 of the same ring is in equal distance away from the driven element 104. It is contemplated that additional arrays of parasitic elements may be utilized. For instance, the parasitic elements in the exemplary antenna system 100 depicted in FIG. 1 forms three rings surrounding the centrally located driven element 104.

Controlling the RF load of each parasitic element may affect mutual coupling and reflectivity of the antenna system 100. For instance, when symmetric loading is applied to the parasitic elements 106, the antenna system 100 may function as an omnidirectional antenna. On the other hand, when asymmetric loading is applied to the parasitic elements 106, the parasitic elements 106 may function as a steerable reflector for reflecting the radiation pattern of the driven element 104, allow a null and a directional beam to be formed accordingly, therefore providing beamforming capabilities to the antenna system 100. The antenna system 100 may also be configured to operate in low gain omni modes with one or more nulls for anti-jam applications in addition to directional patterns with nulls.

A controller (not shown in the figure) may be utilized to selectively apply a load to each parasitic element 106. The controller may be implemented as a processing unit, a computing device, an integrated circuit, or any control logic (stand-alone or embedded) in communication with the parasitic elements 106. The controller may be located on the back of the ground plane 102 and electrically coupled to elements 104 and/or 106 of the antenna system 100. Alternatively, the controller may be located elsewhere and communicate with elements 104 and/or 106 via wired or wireless communication means.

In one embodiment, the controller may be configured to selectively apply a binary switchable load (either on or off) to each parasitic element 106. Since the mutual coupling and the loading of the parasitic elements 106 affect the radiation pattern of the driven element 104, the pattern of the parasitic elements that are switched on and the parasitic elements that are switched off effectively form a steerable reflector to shape the radiation pattern of the driven element 104 accordingly. That is, the parasitic elements may reflect the radiation pattern of the driven element 104 to form desired directional beams and nulls, as illustrated in the examples shown in FIGS. 2 through 4.

Figure 2C:
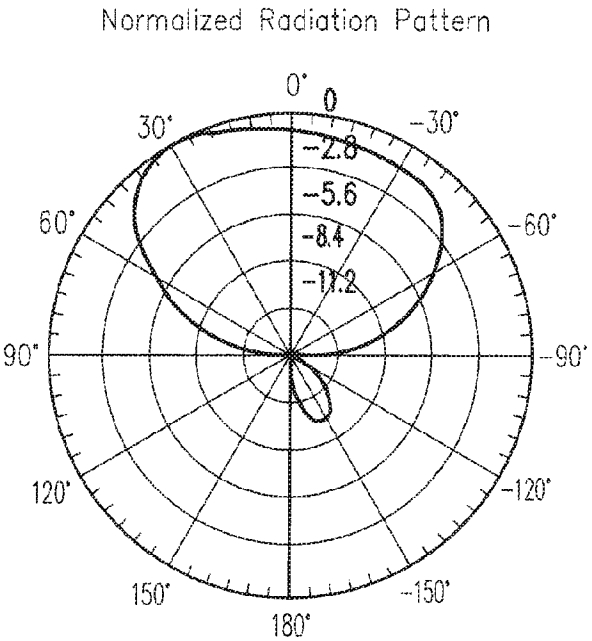
FIGS. 2 through 4 are illustrations depicting a beamforming technique for the parasitic array antenna of FIG. 1 in accordance with the present disclosure.
Figure 2B:
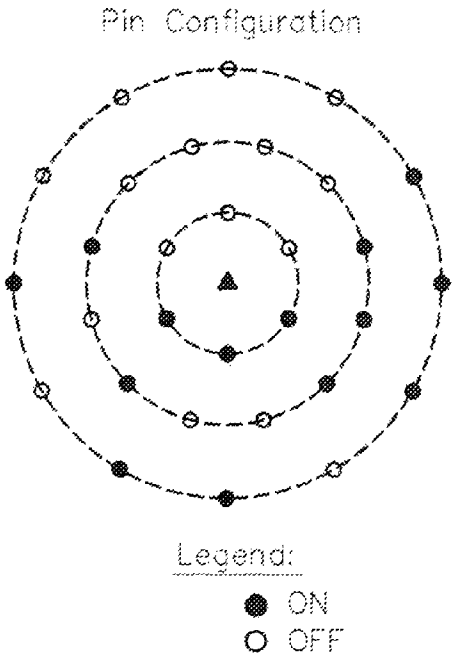
Figure 2A:
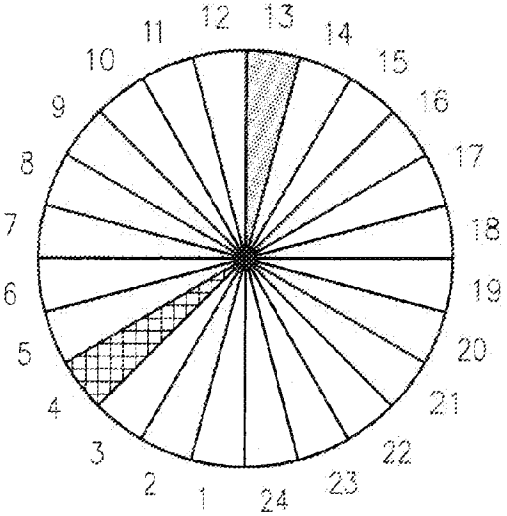

For illustrative purposes, FIG. 2A shows an azimuthal plane (a plane that is parallel with respect to the ground plane 102 in this example) divided into 24 sectors. It is understood, however, that the azimuthal plane may be divided into different number of sectors without departing from the spirit and scope of the present disclosure. As shown in FIG. 2A, suppose it is desirable to produce a directional beam in the direction indicated as sector 13 and a null in the direction indicated as sector 4. FIG. 2B shows the configuration of the parasitic elements 106 to form this desired radiation pattern.

More specifically, as shown in FIG. 2B, by switching on certain parasitic elements and switching off the rest of the parasitic elements, this pattern of parasitic elements forms a steerable reflector for reflecting the radiation pattern of the driven element 104. The normalized result of the measured radiation pattern of the antenna system 100 with the parasitic elements switched on/off according to FIG. 2B is shown in FIG. 2C. It is contemplated that even though the true peak and null of the measured radiation pattern may not exactly correspond to the desired peak and null of FIG. 2A, the beamforming technique in accordance with the present disclosure still performs satisfactorily for most applications.

Figure 3C:
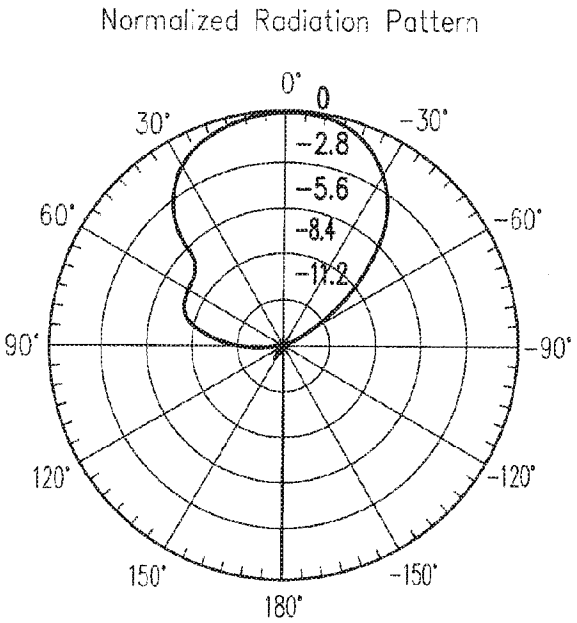
Figure 3B:
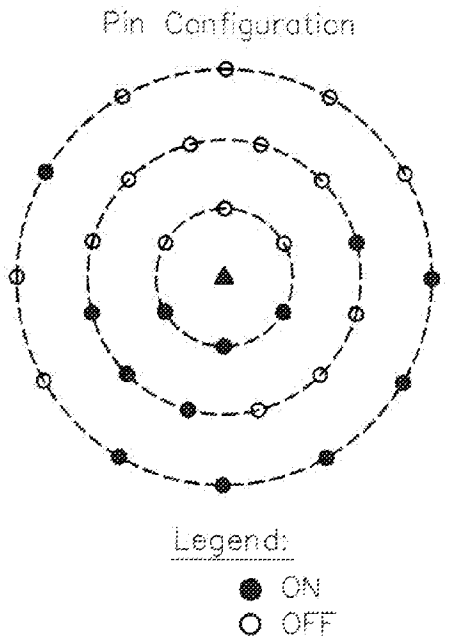
Figure 3A:
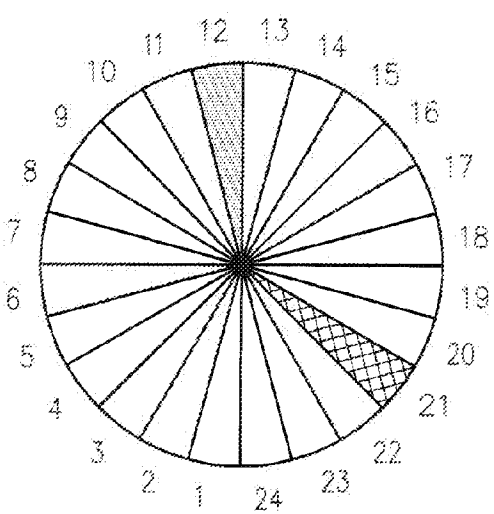
Figure 4C:
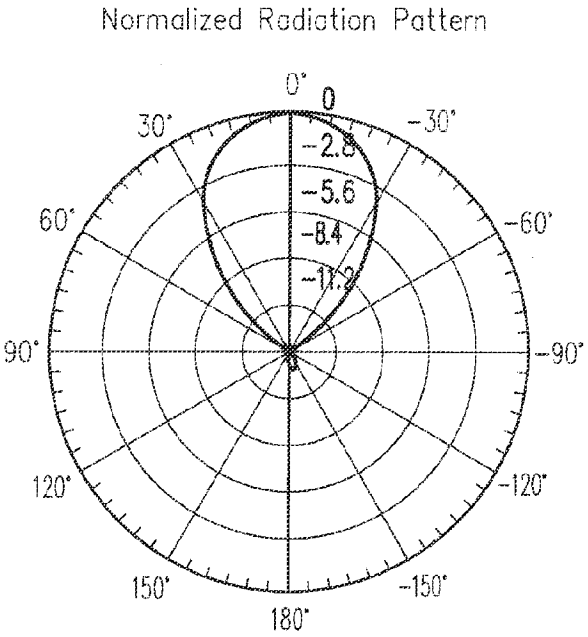
Figure 4B:
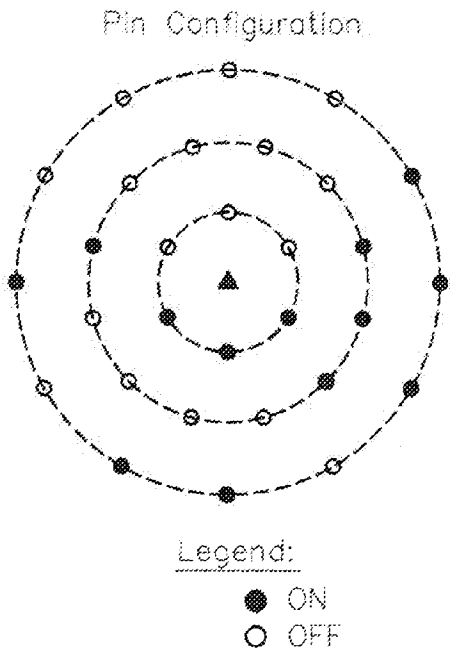
Figure 4A:
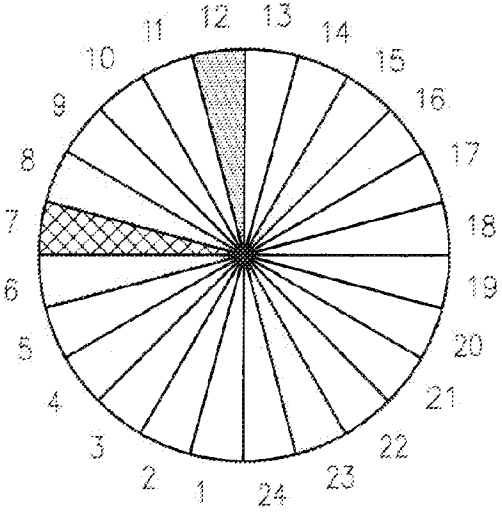

Additional examples of configuring the parasitic elements to form desirable directional beams and nulls for the antenna system 100 are shown in FIGS. 3 and 4. It is noted that the patterns of which the parasitic elements are switched on/off, as shown in FIG. 3B and FIG. 4B, are different from that of FIG. 2B. It is contemplated that different patterns effectively form different steerable reflector for reflecting the radiation pattern of the driven element 104, therefore allowing the directional beams and nulls to be formed dynamically and adaptively, which may be appreciated in various communication environments.

It is contemplated that while the examples shown in FIGS. 2 through 4 depicted the desired peaks and nulls in single sectors, such depictions are merely exemplary. The azimuthal planes may be divided into different number of sectors, and the desired peaks and nulls may correspond to one or more of such sectors without departing from the spirit and scope of the present disclosure.

It is also contemplated that while the examples shown in FIGS. 2 through 4 depicted the antenna system 100 having parasitic elements 106 that form three rings around the driven element 104, such a configuration is merely exemplary. The parasitic elements 106 may form different number of rings around the driven element 104 without departing from the spirit and scope of the present disclosure, as long as each parasitic element is selectively switchable by the controller to jointly form a steerable reflector for reflecting the radiation pattern of the driven element 104.

It is further contemplated that the beamforming technique in accordance with the present disclosure is not limited to the azimuthal plane with respect to the ground plane 102 of the antenna. Beamforming may also be realized in elevation (i.e., in an elevation plane that is perpendicular to the ground plane 102) utilizing the same technique described above. That is, certain parasitic elements may be switched on and the rest of the parasitic elements may be switched off to form a steerable reflector based on the desired peak and null directions in elevation.

Furthermore, it is contemplated that while the load applicable to each parasitic element may be implemented as a binary switchable load (i.e., either on or off), the controller may be configured for selectively applying a variable load to each parasitic element. The variable load may be implemented as a multi-state switchable load or a contiguous variable load or the like without departing from the spirit and scope of the present disclosure.

Figure 5:
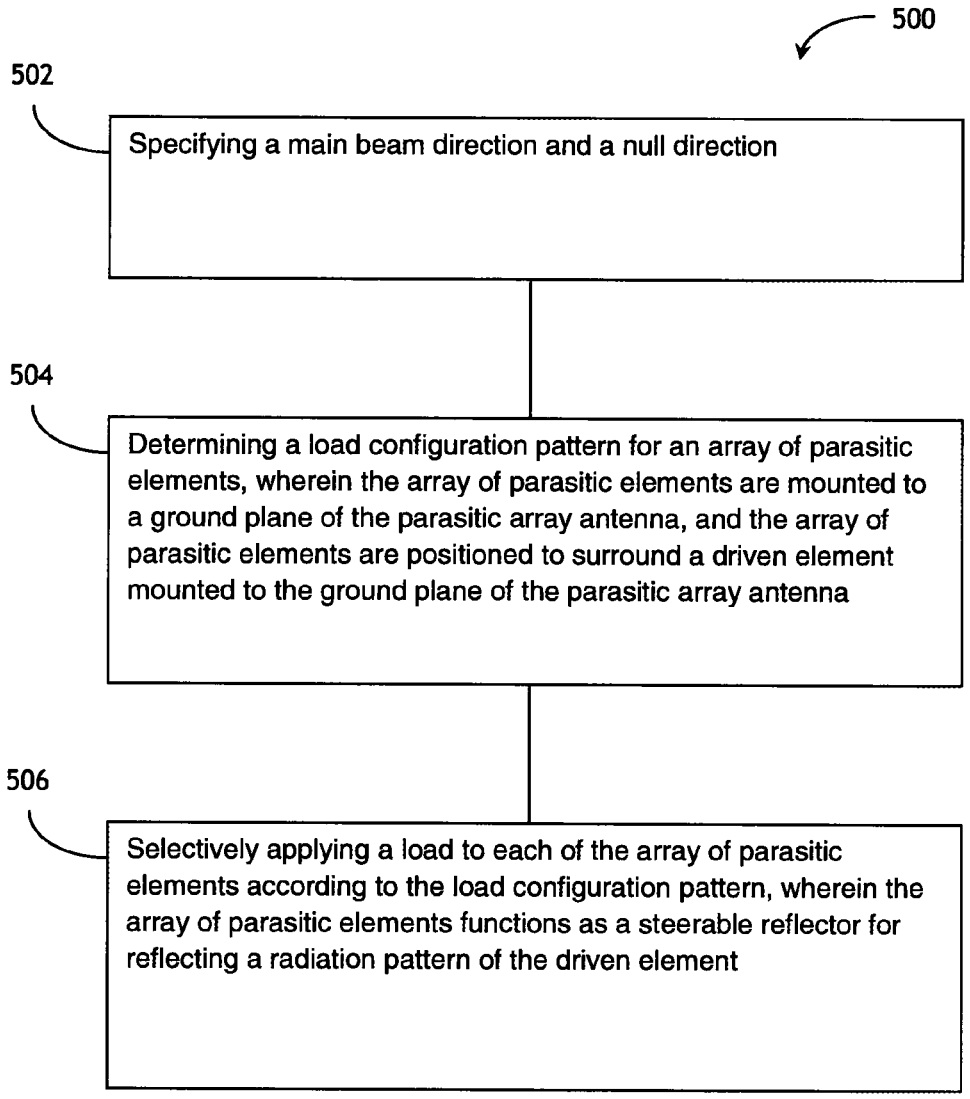
FIG. 5 is a flow diagram depicting a beamforming method for a parasitic array antenna in accordance with the present disclosure.

Referring to FIG. 5, a flow diagram depicting a beamforming method 500 for a parasitic array antenna is shown. As described above, the parasitic array antenna may include a driven element and one or more arrays of parasitic elements surrounding the drive element. In accordance with method 500, the desired main beam direction and the null direction may be specified in step 502. The directions may be specified by a user or a communication system, and step 504 may determine a load configuration pattern for the parasitic elements in order to best achieve the specified directions. For instance, step 504 may estimate the radiation patterns of the parasitic array antenna for various potential load configurations and select a particular load configuration that provides the best match in comparison with the specified directions. Alternatively, a list of predetermined load configurations may be provided (e.g., as a lookup table) for various desirable radiation patterns, and step 504 may select a particular configuration from the predetermined list based on the specified directions. Subsequently, step 506 may selectively apply a load to each parasitic element according to the load configuration pattern determined in step 504.

It is contemplated that the parasitic array antennas and the beamforming method in accordance with the present disclosure provide a low cost solution to steer nulls in desired locations, which may be used to reject interference or background noise. In addition, parasitic array antennas in accordance with the present disclosure may have small physical profiles and may be configured to be switchable between omni and directional operation modes. Such capabilities may allow the parasitic array antennas to be suitable for facilitating various types of communications, such as mobile microwave Intelligence, Surveillance and Reconnaissance (ISR) datalinks or the like.

It is to be understood that the present disclosure may be conveniently implemented in forms of a software package. Such a software package may be a computer program product which employs a computer-readable storage medium including stored computer code which is used to program a computer to perform the disclosed function and process of the present invention. The computer-readable medium may include, but is not limited to, any type of conventional floppy disk, optical disk, CD-ROM, magnetic disk, hard disk drive, magneto-optical disk, ROM, RAM, EPROM, EEPROM, magnetic or optical card, or any other suitable media for storing electronic instructions.

It is understood that the present disclosure is not limited to any underlying implementing technology. The present disclosure may be implemented utilizing any combination of software and hardware technology. The present disclosure may be implemented using a variety of technologies without departing from the scope and spirit of the disclosure or without sacrificing all of its material advantages.

It is understood that the specific order or hierarchy of steps in the processes disclosed is an example of exemplary approaches. Based upon design preferences, it is understood that the specific order or hierarchy of steps in the processes may be rearranged while remaining within the scope of the present disclosure. The accompanying method claims present elements of the various steps in a sample order, and are not meant to be limited to the specific order or hierarchy presented.

It is believed that the present disclosure and many of its attendant advantages will be understood by the foregoing description, and it will be apparent that various changes may be made in the form, construction, and arrangement of the components thereof without departing from the scope and spirit of the disclosure or without sacrificing all of its material advantages. The form herein before described being merely an explanatory embodiment thereof, it is the intention of the following claims to encompass and include such changes.

What is claimed is:

1. An antenna system, comprising:

a ground plane;

a driven element having an omnidirectional radiation pattern mounted to the ground plane;

a set of parasitic elements mounted to the ground plane, the set of parasitic elements forming a plurality of rings surrounding the driven element, wherein each particular ring of the plurality of rings includes a subset of the parasitic elements, and wherein each parasitic element of each particular ring is in equal distance away from the driven element; and a controller configured for selectively applying a radio frequency (RF) load to each of the set of parasitic elements, wherein the set of parasitic elements functions as a steerable reflector for reflecting the radiation pattern of the driven element and forming at least one null.

2. The antenna system of claim 1, wherein a symmetric RF load is applied to the array of parasitic elements, forming an omnidirectional radiation pattern for the antenna system.

3. The antenna system of claim 1, wherein an asymmetric RF load is applied to the set of parasitic elements, forming at least one null for the omnidirectional radiation pattern of the driven element and supporting the driven element to operate in a low gain omnidirectional mode with anti-jamming.

4. The antenna system of claim 1, wherein an asymmetric RF load is applied to the set of parasitic elements, forming a directional radiation pattern having a particular peak and at least one null in a specified direction.

5. The antenna system of claim 4, wherein the directional radiation pattern having the particular peak and the at least one null is formed in at least one of: azimuth or elevation with respect to the ground plane.

6. The antenna system of claim 1, wherein the parasitic elements are identical parasitic elements.

7. The antenna system of claim 1, wherein each particular ring of the plurality of rings is a different distance away from the driven element compared to another ring of the plurality of rings.

8. The antenna system of claim 7, wherein the set of parasitic elements forms three rings surrounding the driven element.

9. The antenna system of claim 1, wherein the RF load selectively applicable to each of the set of parasitic elements is a binary switchable RF load.

10. The antenna system of claim 1, wherein the RF load selectively applicable to each of the set of parasitic elements is at least one of: a multi-state switchable RF load, or a contiguous variable RF load.

11. A beamforming method for a parasitic array antenna, the method comprising:

specifying a main beam direction and at least one null direction;

determining a radio frequency (RF) load configuration pattern for an array of parasitic elements, wherein the array of parasitic elements are mounted to a ground plane of the parasitic array antenna, and the array of parasitic elements are positioned to surround a driven element mounted to the ground plane of the parasitic array antenna; and selectively applying an RF load to each of the array of parasitic elements according to the RF load configuration pattern, wherein the array of parasitic elements functions as a steerable reflector for reflecting a radiation pattern of the driven element and forming at least one null according to the at least one specified null direction.

12. The method of claim 11, wherein the driven element provides an omnidirectional radiation pattern and each parasitic element of the array of parasitic elements is in equal distance away from the driven element.

13. The method of claim 11, wherein the main beam direction and the null direction are specified in at least one of: azimuth or elevation with respect to the ground plane.

14. The method of claim 11, wherein the RF load selectively applicable to each of the array of parasitic elements is a binary switchable RF load.

15. The method of claim 11, wherein the RF load selectively applicable to each of the array of parasitic elements is at least one of: a multi-state switchable RF load, or a contiguous variable RF load.

16. An antenna system, comprising:

a ground plane;

a driven element having an omnidirectional radiation pattern mounted to the ground plane;

an array of parasitic elements mounted to the ground plane, the array of parasitic elements positioned to surround the driven element, and each parasitic element of the array of parasitic elements is in equal distance away from the driven element; and a controller configured for selectively applying a binary switchable radio frequency (RF) load to each of the array of parasitic elements, wherein the array of parasitic elements functions as a steerable reflector for reflecting the radiation pattern of the driven element and forming at least one null.

17. The antenna system of claim 16, wherein a symmetric RF load is applied to the array of parasitic elements, forming an omnidirectional radiation pattern for the antenna system.

18. The antenna system of claim 16, wherein an asymmetric RF load is applied to the array of parasitic elements, forming at least one null for the omnidirectional radiation pattern of the driven element and supporting the driven element to operate in a low gain omnidirectional mode with anti-jamming.

19. The antenna system of claim 16, wherein an asymmetric RF load is applied to the array of parasitic elements, forming a directional radiation pattern having a particular peak and at least one null in a specified direction.

20. The antenna system of claim 16, further comprising:

a second array of parasitic elements mounted to the ground plane, the second array of parasitic elements and the first mentioned array of parasitic elements jointly function as the steerable reflector for reflecting the radiation pattern of the driven element.

* * * * *